US005400713A

United States Patent [19]

Humiston et al.

[11] Patent Number: 5,400,713

[45] Date of Patent: Mar. 28, 1995

[54] STAGE SEPARATION AND THRUST REDUCTION APPARATUS

[75] Inventors: Robert G. Humiston, Pleasant View; Michael A. Behring, Ogden, both of Utah

[73] Assignee: Thiokol Corporation, Ogden, Utah

[21] Appl. No.: 208,940

[22] Filed: Mar. 9, 1994

[51] Int. Cl.[6] ..... F42B 15/36; F41G 9/00; B64D 1/12

[52] U.S. Cl. ..... 102/378; 89/1.140

[58] Field of Search ..... 102/378, 377, 381; 89/1.14

[56] References Cited

U.S. PATENT DOCUMENTS

| | | | |
|---|---|---|---|
| 3,467,992 | 9/1969 | Rabenhorst | 102/378 |
| 3,975,981 | 8/1976 | Seifert | 102/378 |
| 4,171,663 | 10/1979 | Day et al. | 89/1.14 |
| 4,625,649 | 12/1986 | Russell | 102/377 |
| 4,836,081 | 6/1989 | Graves et al. | 102/378 |
| 5,129,306 | 7/1992 | Fauvel | 89/1.14 |

*Primary Examiner*—David Brown
*Attorney, Agent, or Firm*—Ronald L. Lyons

[57] ABSTRACT

An apparatus is disclosed for stage separation and thrust termination in a multi-stage missile having an upper stage detachably connected to a lower stage rocket motor. The apparatus includes a piston located at the forward end of the lower stage rocket motor in fluid communication with the motor's combustion chamber. The piston is configured with a plurality of venting passages, and capable of deployment from a stowed position, in which the venting passages are sealed, to an extended position, in which the venting passages are unsealed. The venting passages are preferably configured to vent the combustion chamber at an angle to the upper stage, providing the lower stage rocket motor with a component of thrust away from the upper stage after detachment without damaging the upper stage. In a preferred embodiment, means for detaching the upper stage includes attachment bolts connecting the stages and explosive detachment charges configured to shear the bolts. The bolt fragments are preferably captured and retained in one or both stages. The piston outside perimeter preferably increases toward the aft end of the piston to increase drag on the piston as the piston deploys toward the extended position.

20 Claims, 5 Drawing Sheets

STAGE SEPARATION AND THRUST REDUCTION APPARATUS

BACKGROUND

1. Field of the Invention

The present invention is related to an apparatus for separating stages and reducing thrust when a lower stage rocket motor of a multi-stage missile system is detached from an upper stage rocket or payload. More particularly, the present invention is related to an apparatus for separating a lower stage rocket motor from an upper stage without producing foreign object debris and for reducing the forward thrust of the lower stage rocket motor.

2. Technical Background

The use of multiple stage rocket motors has long been known as an effective means of increasing propulsion efficiency in a missile system. In a multi-stage missile system, an upper stage carrying a payload sits atop one or more lower stage rocket motors. Each lower stage rocket motor contains propellant within a case. The missile's propulsion system is typically initiated by igniting the lowest stage rocket motor. As the propellant burns, the combustion products are rapidly expelled out the aft end of the motor to provide thrust to the missile system.

Upon burnout of the motor or at some other desired time, stage separation and thrust reduction of the separated stage may be effected. Stage separation includes detaching the lowest stage rocket motor from the remainder of the missile. Following detachment, the lowest stage rocket motor is physically isolated from contact with the upper stage. Isolation is generally promoted by implementing some form of thrust reduction in the lower stage motor. Separating the unneeded stage from the missile typically improves propulsion efficiency by reducing the mass that rocket motors in subsequent stages must propel. If the next higher stage contains a rocket motor, that stage then becomes the current lower stage rocket motor. This new lower stage rocket motor may then be ignited to provide further propulsion to the missile. In this way, successive stages of rocket motors propel the payload toward its destination.

Multiple rocket motors may also be employed to increase the stealth capabilities of a missile system. Upon burnout of an initial stage motor, the spent motor may be detached. The pay-load may then coast a predetermined distance before ignition of the next stage, thereby reducing the risk of detection by heat-seeking missiles or other missile surveillance equipment.

Typical detachment mechanisms for releasing a rocket motor include a small explosive device which shears bolts or other retaining systems to release the lower stage rocket motor structure from the adjacent upper stage. Following detachment, the unneeded rocket motor is free to fall to the earth while the missile continues along its trajectory.

One of the most serious deficiencies of prior art systems for detaching lower stage rocket motors is that many such systems release debris into the air during the detachment process. Such debris, typically termed "foreign object debris," may include washers, bolt fragments and clamps utilized in the attachment of the lower stage rocket motor to the missile upper stage, as well as blow-out plugs, retainers and other hardware used to effect venting of the combustion chamber of the lower stage rocket motor. This debris poses grave risks to aircraft maneuvering near the missile.

Because many multi-stage missiles are designed to be launched from aircraft or otherwise utilized in areas where air-craft are deployed, aircraft may often be flying near such missiles during stage separation. Any collision between rocket motor debris and an aircraft is obviously undesirable. Debris from a separated rocket motor which is sucked into the jet engine of an airplane may severely damage the engine. Such engine damage may cause a loss of power to the plane, resulting in possible loss of the aircraft.

It is generally not feasible for pilots to avoid foreign object debris released during stage separation of missile systems. Even though the flight paths of multi-stage missiles are carefully planned, the path of expelled debris is difficult to control because individual pieces of debris may have shapes that are aerodynamically unpredictable. In addition, the small size of the debris and the high closure velocities at which an air-craft may encounter the debris generally make it impossible for pilots to visually detect and avoid oncoming debris.

Another serious deficiency of prior art designs relates to the manner in which they pursue separation of the upper stage from the lower stage rocket motor after detachment. Separation must be accomplished while addressing two primary concerns. First, the upper stage should be protected against exposure to combustion products from the lower stage rocket motor. In recognition of this concern, some conventional designs separate stages only after the lower stage rocket motor has burned out. A drawback of this approach is that optimal stage separation timing may be dictated by factors other than the amount of fuel left in the lower stage rocket motor. Such factors may include the risk posed by nearby heat-seeking missiles or the danger that continued thrust from the lower stage rocket motor will drive the missile off course or cause it to exceed the aerodynamic or structural limits of the missile. Such factors become increasingly important in missile systems designed to provide a high degree of mission flexibility.

A second principal concern to be addressed during separation is that a collision between the detached lower stage and the upper stage be avoided. Immediately following lower stage rocket motor detachment, the lower stage rocket motor and the upper stage are moving at essentially the same velocity. However, differences in the air resistance of these two bodies, possibly combined with post-separation thrust of the lower stage rocket motor, may cause a collision between the detached lower stage rocket motor and the missile upper stage. Such a collision could detrimentally alter the course of the missile. A collision may also damage fins or other portions of the upper stage.

Some conventional designs attempt to achieve separation by merely relying on wind resistance to slow the flight of the spent rocket motor case. In many cases, however, wind resistance alone acts too slowly to be effective. Also, reliance upon wind resistance is not possible outside the atmosphere.

Other designs utilize a drogue parachute or other aerodynamic drag-inducing device to slow the flight of the detached stage. Such designs are generally incapable of imparting sufficient drag to the detached stage to ensure safe and efficient stage separation. Also, many such designs are too expensive and complex to incorporate in many applications.

Simply firing an upper stage rocket motor to carry the missile away from the lower stage rocket motor is not always an adequate solution. The upper stage motor cannot begin firing before lower stage detachment and will not reach full power until some tens of milliseconds after ignition. The lower stage rocket motor may travel into the upper stage during this period. Furthermore, when the last rocket motor is separated from the pay-load, it is not always possible to fly the pay-load away from the detached stage. Some alternative measure is therefore needed to reduce or eliminate the risk of the lower stage rocket motor colliding with the upper stage after detachment.

From the foregoing, it will be appreciated that it would be an advancement in the art to provide a missile stage separation apparatus which does not produce foreign object debris.

It would also be an advancement in the art to provide such an apparatus that facilitates rapid separation of the lower stage rocket motor from the missile upper stage, thereby preventing the stages from colliding or otherwise adversely affecting the trajectory of the missile upper stage.

Such an apparatus is disclosed and claimed herein.

BRIEF SUMMARY OF THE INVENTION

The present invention is directed to an apparatus for stage separation and thrust termination in a multiple stage missile. In a preferred embodiment, the forward end of the lower stage rocket motor contains a piston which is positioned in fluid communication with the lower stage rocket motor's combustion chamber. The piston is generally cylindrical and is mounted within a piston guide such that it may deploy from a stowed position, in which it is positioned mainly within the lower stage rocket motor, to an extended position, in which the forward end of the piston extends out the forward end of the lower stage rocket motor case.

When the piston is in its stowed position, its forward end lies within an annular piston guide collar. The piston's aft end includes an outwardly extending flange configured to engage the piston guide collar when the piston reaches the extended position. Thus, the flange acts as a stop as the piston reaches the extended position.

Between the piston's forward end, which fits through the piston collar, and the piston's aft end flange, which does not, lies a tapered section. The tapered section of the piston is configured with an increasing outside diameter toward its aft end.

A mastic cavity is defined by the piston guide, piston side, piston guide collar, and piston flange. Extrusion holes in the piston flange connect the mastic cavity with the rocket motor's combustion chamber. A mastic material is located inside the mastic cavity.

The piston is further configured with a plurality of venting passages for venting the combustion chamber. The venting passages are preferably configured to vent through the side of the piston when the piston is in or near the extended position. The venting passages are sealed when the piston is in its stowed position.

The venting passages are directed generally toward the forward end of the missile such that a component of reverse thrust is imparted to the lower stage rocket motor as the rocket motor's exhaust is vented through the passages. The passages have an angular orientation relative to the longitudinal axis of the missile such that plumes of combustion products emitted from the passages during venting do not point directly at the upper stage. The passages are also configured symmetrically about the longitudinal axis of the lower stage rocket motor.

The total cross-sectional area and the angular orientation of the passages affect the total amount of reverse thrust acting on the lower stage rocket motor. Any degree of thrust reduction in the lower stage rocket motor will assist separation. However, the passages are preferably configured such that the combined effect of total area and angular alignment of the passages produces a reverse thrust component that exceeds the forward thrust produced by the lower stage rocket motor nozzle. So configured, the net thrust on the lower stage rocket motor will be reverse thrust.

The lower stage rocket motor and the upper stage are initially secured together by attachment bolts or other means which can be remotely disconnected to detach the missile upper stage from the lower stage rocket motor. This connection is typically accomplished by mounting an annular buttress to the forward end of the lower stage rocket motor case. The annular buttress and the upper stage case are then bolted together with the attachment bolts.

Explosive detachment charges are positioned within the attachment bolts. Upon command, the charges act explosively to shear the attachment bolts, thereby causing the upper and lower stages to become detached and initiating stage separation. A bolt fragment cavity located within the annular buttress contains an energy absorbing material for catching and retaining any attachment bolt fragments generated when the explosive detachment charges are detonated. The bolt fragment cavity is bounded by the lower stage rocket motor case, the annular buttress, and a pusher pan.

The pusher pan is secured to the forward end of the piston and configured to abut the aft end of the upper stage structure. The pusher pan is not attached to the upper stage structure. Prior to detachment of the lower stage rocket motor, the attachment bolts hold the upper stage against the pusher pan, thereby maintaining the piston in the stowed position.

In operation, the apparatus of the present invention is actuated during the burn of the lower stage rocket motor. In accordance with the teachings of the present invention, stage separation is conducted in three phases. Initially, the lowest stage rocket motor is detached from the missile upper stage. Detachment includes severing all physical connections between the stages. However, after detachment, the stages may still be traveling in tandem because their velocity vectors match.

The detachment phase begins with detonation of the explosive charges in the attachment bolts, thereby breaking the attachment bolts and detaching the lower stage rocket motor from attachment to the upper stage missile. A portion of each bolt is retained in the upper stage. Any loose bolt fragments are expelled into the bolt fragment cavity and are retained by the energy absorbing material positioned there. After the detachment phase, the lower stage rocket motor is free to move relative to the upper stage.

In the second phase of stage separation, the piston is deployed to commence physical separation of the upper stage from the lower stage rocket motor. In this deployment phase, pressure within the lower stage rocket motor's combustion chamber bears against the piston, forcing it to deploy from the stowed position toward the extended position. As it deploys, the piston presses against the pusher pan, which in turn pushes the upper stage away from the lower stage rocket motor.

Because of the extreme pressures present within the combustion chamber of the lower stage rocket motor during combustion, the piston accelerates rapidly toward its extended position when the attachment bolts are broken. Measures are therefore taken to prevent the piston from being completely ejected from the lower stage rocket motor case and endangering nearby aircraft.

As the piston deploys from the stowed position to the extended position, the gradually increasing outside diameter of the piston results in mechanical interference between the piston and the piston guide, thereby inducing substantial drag. A portion of the piston's kinetic energy is absorbed as the tapered section of the piston is forced through the piston guide collar.

In addition, deployment of the piston from the stowed position to the extended position decreases the size of the mastic cavity, thereby compressing the mastic within the reduced cavity. The piston flange, which forms a portion of the mastic cavity boundary, hydraulically presses against the compressed mastic. The force exerted by the piston flange against the mastic compressed in the mastic cavity hydraulically extrudes the mastic through the small extrusion holes or other openings in the flange. A substantial portion of the piston's kinetic energy is absorbed by this hydraulic extrusion process.

The increased drag resulting from the mechanical interference between the piston and piston guide acting in combination with the mastic hydraulic extrusion process slows the piston's movement as it approaches the extended position. If the piston has sufficient momentum to reach the extended position, the piston guide collar will engage the piston flange, thereby acting as a stop to retain the piston in engagement with the lower stage rocket motor.

As the piston deploys toward the extended position, the piston's venting passages are unsealed, thereby venting the combustion chamber. The angle between the passages and the rocket's longitudinal axis ensures that a component of the resulting port thrust is in the aft direction. The resulting thrust reduction aids the physical separation of the lower stage rocket motor from the upper stage during the deployment phase.

Finally, the upper stage is isolated from the detached lower stage rocket motor. During this isolation phase, the upper stage is isolated from contact with the lower stage rocket motor by creating a spatial gap between the upper and lower stages. The creation of this gap may be assisted or wholly accomplished by thrust reduction in the lower stage rocket motor upon deployment of the piston while allowing the remainder of the missile to travel forward. If the magnitude of the thrust reduction is sufficient, the forward thrust of the lower stage rocket motor may be terminated or reversed.

In a preferred embodiment, the passages in the piston are configured sufficiently large that the forward thrust of the lower stage rocket motor is smaller than the aftward port thrust component, resulting in the net thrust on the lower stage rocket motor being in the reverse direction. The rapid reversal of thrust on the detached lower stage rocket motor causes it to quickly become isolated from the upper stage.

During the isolation phase, the upper stage is also protected from contact with lower stage rocket motor combustion products. Protection is initially provided by the angular orientation of the venting passages, causing the vented plumes to be directed away from the upper stage. Protection against lower stage rocket motor emissions is later provided by the spatial gap created between the upper and lower stages, since the exhaust plumes have limited length.

Once the lowest stage rocket motor is separated from the upper stage, the next stage rocket motor may be ignited to further propel the missile towards its destination. The detached lower stage rocket motor is then free to fall to the earth as one integral piece, with the piston, the pusher pan, and captured bolt fragments still attached to the lower stage. The apparatus therefore achieves rapid and effective stage separation and thrust reduction while producing no foreign object debris to endanger nearby aircraft.

From the foregoing it will be appreciated that one object of the present invention is to provide a missile stage separation and thrust reduction apparatus which does not produce foreign object debris. It is also an object of the present invention to provide such an apparatus that facilitates rapid separation of the lower stage rocket motor from the upper stage, thereby preventing the stages from colliding or otherwise adversely interacting.

Other advantages and features of the invention will become apparent upon reading the following detailed description and appended claims, and upon reference to the accompanying drawings.

BRIEF DESCRIPTION OF THE DRAWINGS

In order that the manner in which the above-recited and other advantages and objects of the invention are obtained may be understood, a more particular description of the invention briefly described above will be rendered by reference to the appended drawings. Understanding that these drawings only provide information concerning typical embodiments of the invention and are not therefore to be considered limiting of its scope, the invention will be described and explained with additional specificity and detail through the use of the accompanying drawings, in which.

DETAILED DESCRIPTION OF THE PREFERRED EMBODIMENTS

Figure 1:
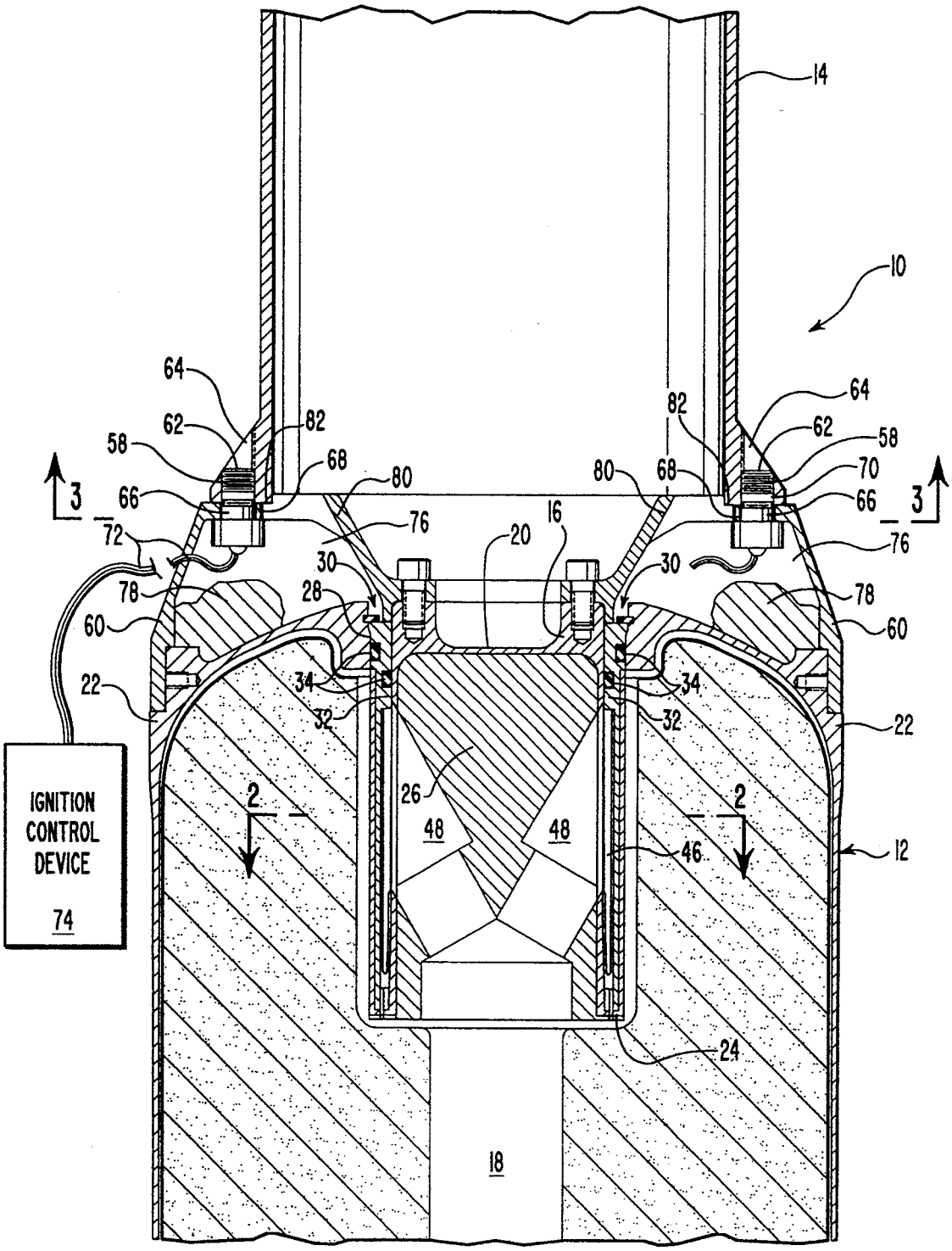
FIG. 1 is a cross-sectional plan view of a presently preferred embodiment of the present invention, showing the piston in its stowed position before the lower stage rocket motor is detached from the upper stage.

The present invention for stage separation and thrust termination in a multi-stage missile is best understood by reference to the attached drawings wherein like parts are designated with like numerals throughout. As illustrated in FIG. 1, a presently preferred apparatus built in accordance with the teachings of the present invention is generally designated at 10.

The apparatus 10 is mounted in a lower stage rocket motor 12 in a multi-stage missile. The lower stage rocket motor 12 is connected to an upper stage 14 of the missile. The apparatus 10, which is positioned in the forward end of the lower stage rocket motor 12, contains a piston 16. The piston 16 is mounted in the lower stage rocket motor 12 such that it is in fluid communication with the lower stage rocket motor's combustion chamber 18.

Figure 2:
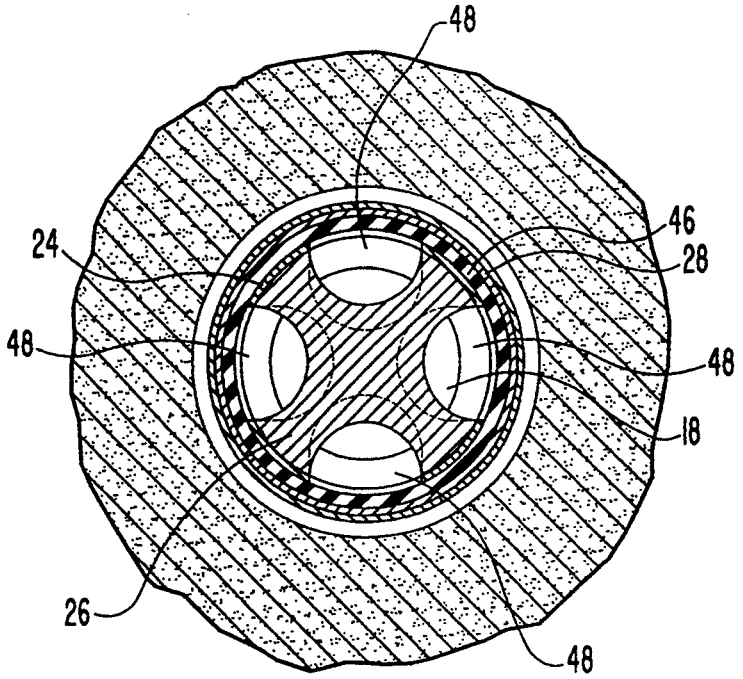
FIG. 2 is a cross-sectional view taken along line 2—2 of FIG. 1.

In this presently preferred embodiment, as illustrated in FIGS. 1 and 2, the piston 16 is constructed as a substantially cylindrical metal shell 24 disposed about a block of heat-resistant material 26. Those of skill in the art will appreciate that alternatives to this cylindrical shell configuration, such as pistons constructed of a single continuous material in a variety of geometric configurations, also lie within the scope of the present invention. The heat-resistant material 26 may be any material, such as silica phenolic, that is capable of substantially maintaining its shape in the presence of the temperatures and pressures generated by combustion of the propellant. The metal shell 24 may be formed of conventional alloys.

Figure 6:
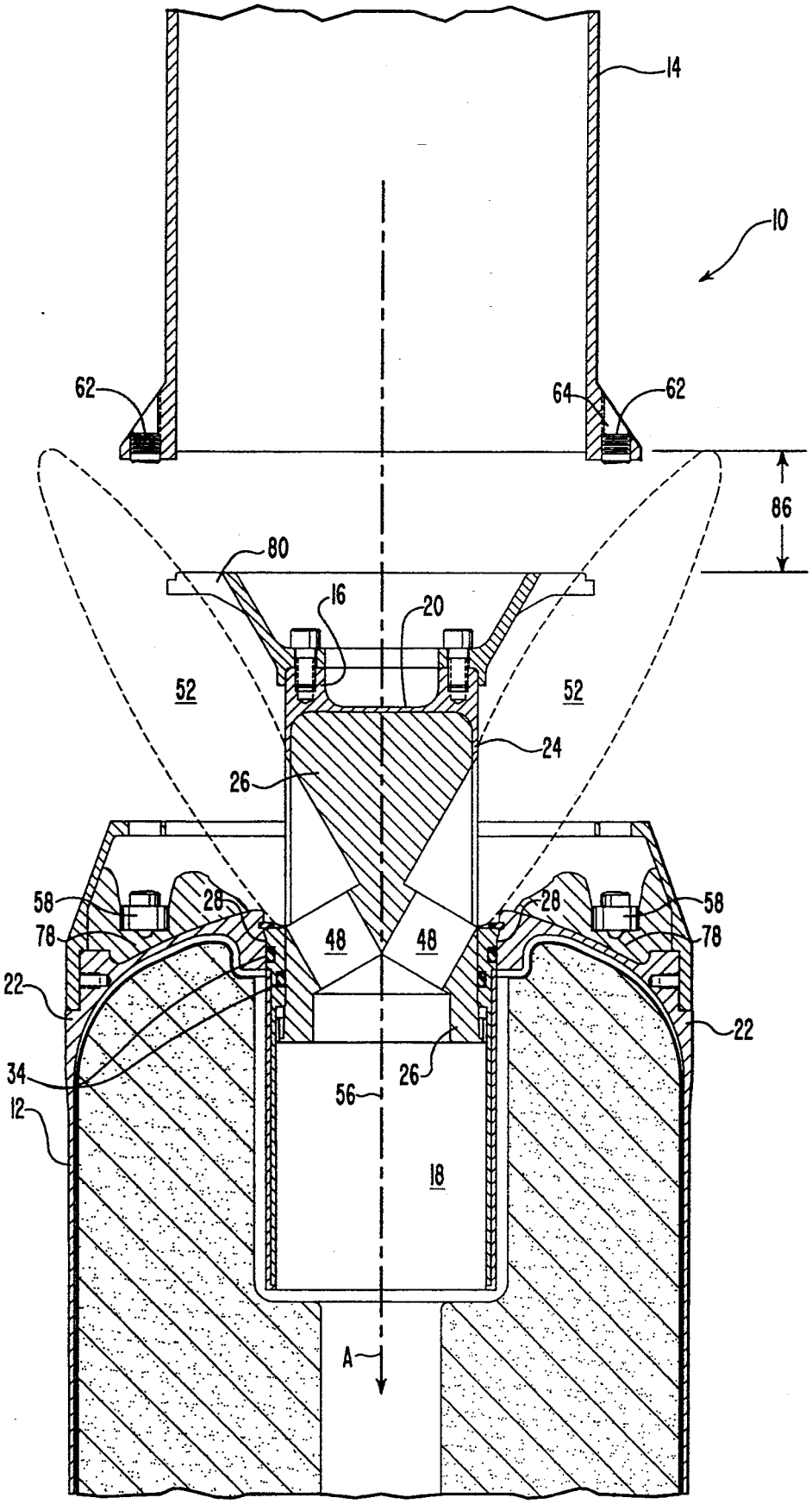
FIG. 6 shows the apparatus of FIG. 1 after the upper and lower stages have separated and a spacial gap has been created between the stages.

The piston 16 is mounted within a piston guide 28 such that it may slide from a stowed position, as shown in FIG. 1, to an extended position, as shown in FIG. 6. As illustrated in FIG. 1, in the stowed position the piston 16 is positioned within the lower stage rocket motor 12. FIG. 6 illustrates that in the extended position, by contrast, the forward end 20 of the piston 16 extends out the forward end of a lower stage rocket motor case 22.

The piston guide 28 is mounted to the lower stage rocket motor case 22 in an orifice 30. Upon deployment of the piston 16 from the stowed position to the extended position, a portion of the piston 16 travels through this orifice 30.

When the piston 16 is in the stowed position, its forward end 20 lies within an annular piston guide collar 32. The piston guide collar 32 is preferably integral with the piston guide 28. To prevent leakage of combustion products from the rocket motor combustion chamber 18, seals 34 are incorporated between the piston 16 and the piston guide collar 32 and between the piston guide 28 and the case 22.

Figure 4:
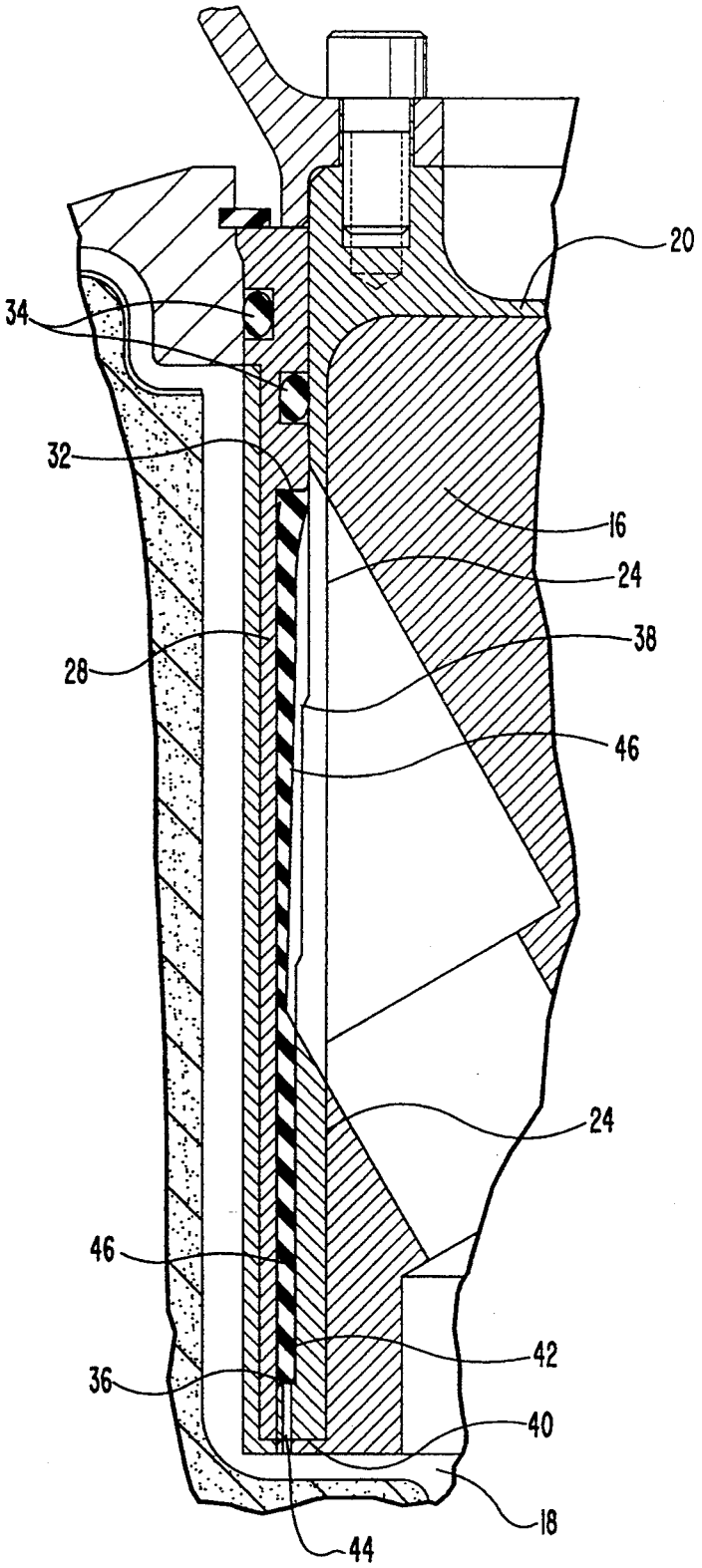
FIG. 4 is an enlarged view of a portion of FIG. 1, further illustrating the piston and the piston guide.

The aft end of the piston 16 includes an outwardly extending flange 36 configured to engage the piston guide collar 32, as best shown in FIG. 4. The flange 36 acts as a stop as the piston 16 reaches the extended position shown in FIG. 6.

With reference again to FIG. 4, the side of the piston 16 preferably includes a stepped or tapered section 38. When the piston 16 is in its stowed position, the tapered section 38 lies between the forward end 20 of the piston 16 and the flange 36 at the piston's aft end. The tapered section 38 is configured with a gradually increasing outside diameter toward its aft end 40. Although FIG. 4 illustrates a presently preferred embodiment wherein the tapered section 38 has discrete steps, those of skill in the art will appreciate that a tapered section having a continual gradual taper, a series of ridges, or other tapered geometries may also be successfully employed. Such equivalent geometries also lie within the scope of the present invention.

As illustrated in FIG. 4, the apparatus of the present invention is further configured with a mastic cavity 42 which is defined by the piston guide 28, the side of the piston 16, the piston guide collar 32, and the piston flange 36. A plurality of extrusion holes or other openings 44 are located in the piston flange 36 and provide fluid communication between the mastic cavity 42 and the combustion chamber 18 of the lower stage rocket motor. A mastic material 46 is located inside the mastic cavity 42 and preferably substantially fills the mastic cavity 42.

The mastic material 46 is preferably a material which has thermal insulation properties. When used as an insulator, the mastic material 46 is positioned to substantially surround the piston 16 and the piston guide 28, thereby helping to protect the piston 16 and the piston guide 28 from the combustion heat of the lower stage rocket motor 12 while the piston 16 is in the stowed position.

The mastic material 46 may include virtually any material which will extrude through the extrusion openings 44 when acted upon by a substantial pressure from within the mastic cavity 42. Suitable mastic materials 46 include organic or inorganic polymers or oil compounds having high-temperature viscosity tailored according to principles known in the art. Such materials will preferably also have thermal insulation capabilities. The mastic material 46 may include, for instance, silicone-based polymer, mineral oil compound, long-carbon-chain polymer, natural rubber, or synthetic rubber.

Figure 5:
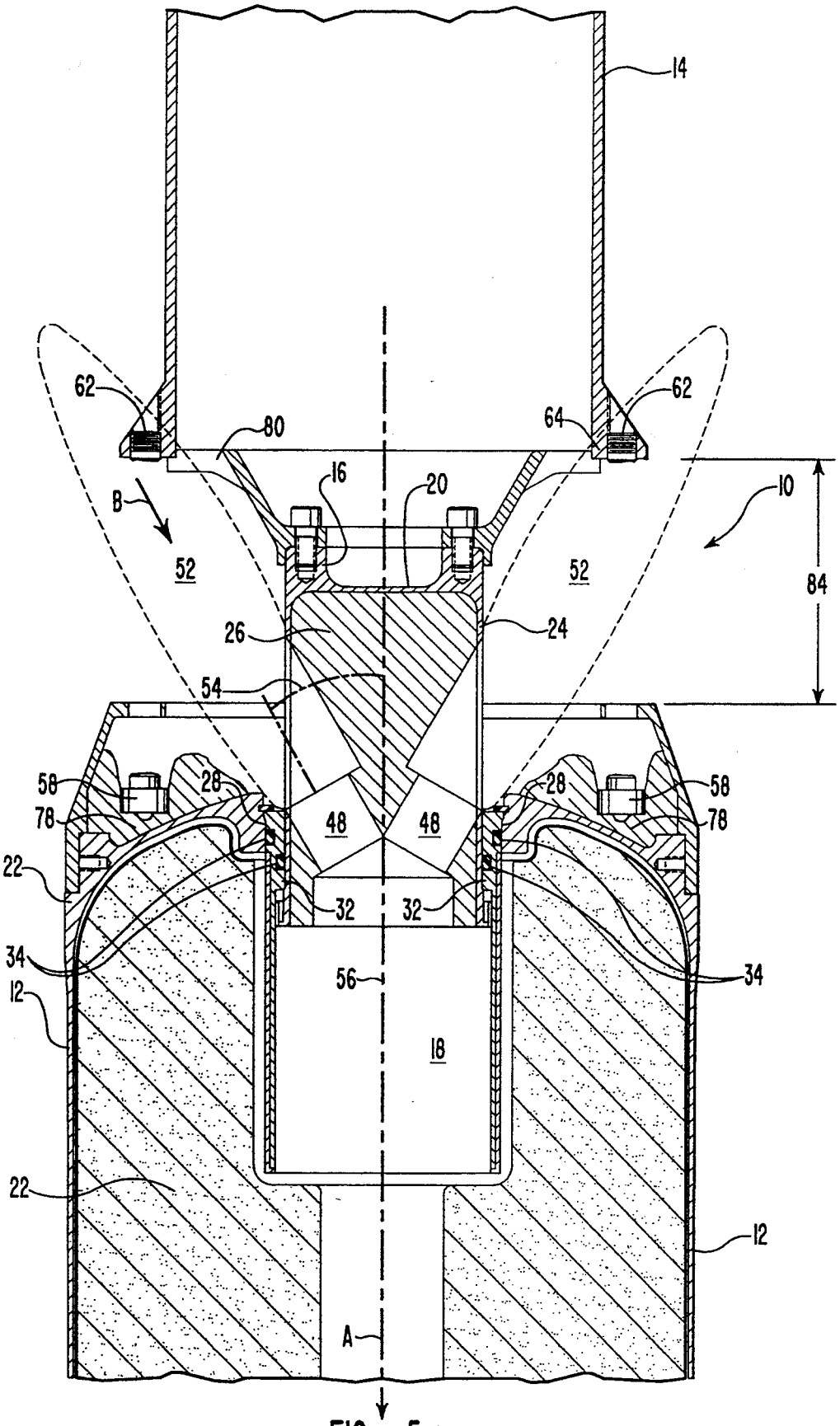
FIG. 5 shows the apparatus of FIG. 1 after the detachment charges have been detonated, the upper and lower stages have partially separated, and the venting passages in the piston have been unsealed.

As shown in FIGS. 1 and 2, the piston 16 is further configured with a plurality of venting passages 48 for venting the combustion chamber. The venting passages 48 are preferably configured to vent through the side of the piston 16 when the piston 16 is in or near the extended position, as shown in FIGS. 5 and 6. The venting passages 48 are sealed when the piston 16 is in its stowed position, as shown in FIG. 1. The seals 34 assist in containing the combustion products inside the lower stage rocket motor 12 when the piston 16 is stowed.

As illustrated in FIG. 5, the venting passages 48 are directed generally toward the forward end of the multi-stage missile such that a component of reverse thrust is imparted to the lower stage rocket motor 12 as the motor is vented through the piston's venting passages 48. As used herein, "reverse thrust" is thrust directed toward the aft end of the missile, as indicated by Arrow A. During venting, each passage 48 emits a plume 52 of combustion products.

The venting passages 48 are preferably disposed at an angle 54 relative to the longitudinal axis 56 of the rocket motor such that the plumes 52 of combustion products do not point directly at the upper stage 14 during venting. Those of skill in the art can determine this angle 54 by conventional means from known factors such as the dimensions and geometry of the missile, the size of the passages 48, and the operating characteristics of the lower stage rocket motor.

As FIG. 5 illustrates, the passages 48 are also configured symmetrically about the longitudinal axis 56. However, those of skill in the art will appreciate that passage configurations other than those illustrated will also provide thrust reduction and lie within the scope of the present invention.

The total cross-sectional area of the passages 48 is preferably sufficiently large that the net reverse thrust acting upon the lower stage rocket motor 12 is in the aft direction, as indicated by Arrow A, when the passages 48 are exposed. The cross-sectional area of the passages 48 affects the total amount of piston thrust, which is in the direction indicated by Arrow B for a given passage 48. The angular orientation of the passages 48 provides a component of thrust that acts in the aft direction. Thus, for a given passage, the component of reverse thrust is essentially the thrust generated by the expulsion of combustion products through the passages 48 (in the direction of Arrow B) multiplied by the cosine of the angle 54.

The passages 48 are preferably configured such that the sum of the reverse thrust components generated by the passages 48 exceeds the forward thrust produced by the lower stage rocket motor. This preferred configuration provides a net thrust on the lower stage rocket motor 12 in the aftward direction.

As FIG. 1 illustrates, the lower stage rocket motor 12 and the upper stage 14 are initially connected by attachment bolts 58. This connection is accomplished by conventionally mounting an annular buttress 60 to the forward end of the lower stage rocket motor case 22. The annular buttress 60 and the upper stage 14 are then bolted together with the attachment bolts 58. An upper portion 62 of each attachment bolt 58 is threaded into a bolt hole 64 in the upper stage 14. A lower portion 66 of each attachment bolt 58 extends through a corresponding bolt channel 68 in the annular buttress 60. Of course, one of skill in the art will appreciate that the lower stage rocket motor may be attached to the upper stage by a variety of means which are suitable to accomplish the purposes of the present invention.

Explosive detachment charges 70 are positioned near each attachment bolt 58 for shearing the bolts 58 to initiate stage separation. In a presently preferred embodiment, the charges 70 are located within the bolts 58. Wires 72 connect the detachment charges 70 to a conventional ignition control device 74. The bolts 58 and charges 70 may be conventionally available bolts and charges, such as the integrated bolt and charge sold under the trademark TECHBOLT and available from Explosive Technologies of Fairfield, Calif., or substantially similar components available from Hi-Shear Technologies Corporation or from Ensign Bickford.

A bolt fragment cavity 76 located within the annular buttress 60 of the lower stage contains a energy absorbing material 78 for catching and retaining fragments of the attachment bolts 58 which may be generated upon detonation of the explosive detachment charges 70. The bolt fragment cavity 76 is bounded by the lower stage rocket motor case 22, the annular buttress 60, and a pusher pan 80. The energy absorbing material 78 may be a material such as clay or putty which is deformable under the force of impact of a flying bolt fragment and which tends to remain in the shape to which it has been deformed by the impact, thereby retaining the bolt fragment.

Figure 3:
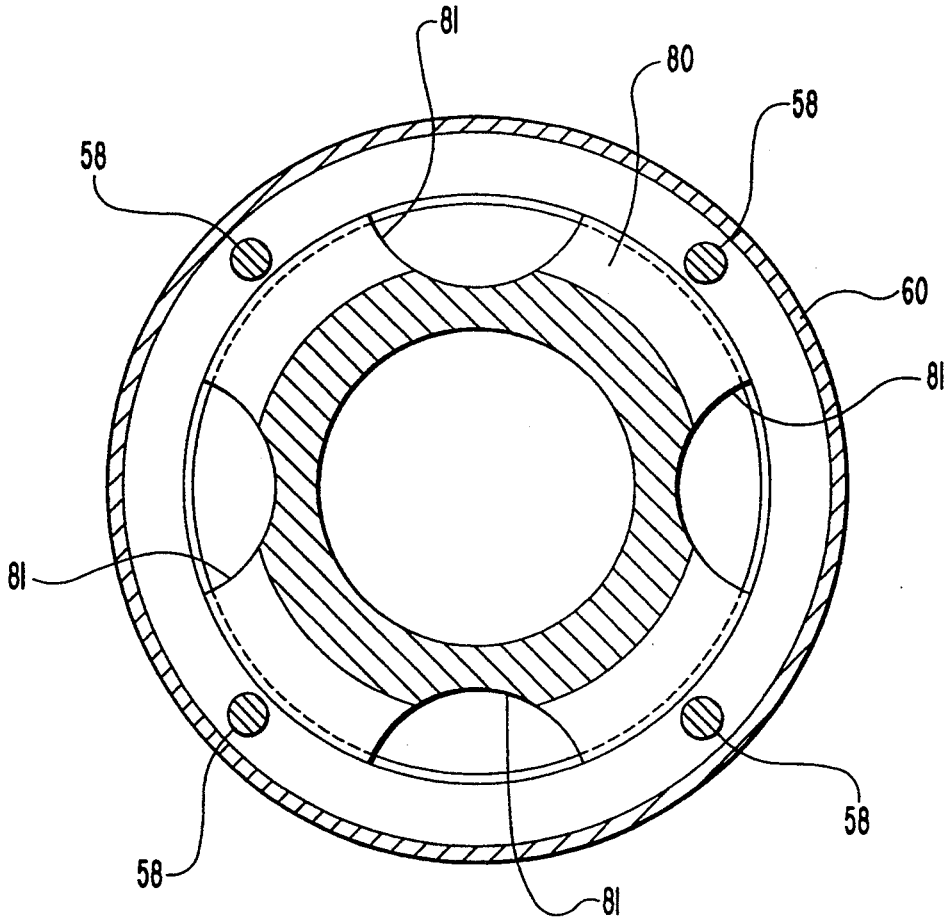
FIG. 3 is a cross-sectional view taken along line 3—3 of FIG. 1.

The pusher pan 80 is secured to the forward end 20 of the piston 16 and is configured to abut the upper stage 14 at a force transfer region 82 without the pusher pan 80 being physically secured to the upper stage 14. Prior to detachment of the lower stage rocket motor 12, the attachment bolts 58 hold the upper stage 14 against the pusher pan 80, thereby maintaining the piston 16 in the stowed position. As illustrated in FIG. 3, the pusher pan 80 is configured with cut-outs 81 to accommodate the plume of combustion products which will exit the lower stage rocket motor through the venting passages.

In operation, the apparatus may be actuated in the final stages of burn of the lower stage rocket motor. Importantly, the apparatus of the present invention may be actuated at any time during the burn of the lower stage rocket motor thereby making it an ideal candidate for use in multi-mission systems where great flexibility is desired. The detachment phase of stage separation begins with detonation of the explosive detachment charges 70 in response to a remotely actuated signal which is propagated along the wire 72 from the ignition control device 74, as illustrated in FIG. 1. Each detonating charge 70 breaks the corresponding attachment bolt 58. When the attachment bolts 58 are broken, a portion of each bolt 58 is retained in the upper stage 14. Any loose fragments of the bolts 58 are expelled into the bolt fragment cavity 76 and are retained by the energy absorbing material 78 in the lower stage rocket motor 12.

With all attachment bolts 58 broken, the lower stage rocket motor 12 is free to move relative to the upper stage 14. Those of skill in the art will appreciate, however, that the lower stage rocket motor 12 and the upper stage 14 will generally tend to continue traveling near one another in the absence of any further forces. The risk of collisions between the stages 12 and 14 is thus significant unless additional steps are taken.

In the second phase of stage separation, the piston is deployed, causing the upper stage 14 to begin to separate from the detached lower stage rocket motor 12. During this deployment phase the upper stage 14 is separated from the lower stage rocket motor 12 by a distance 84 between the upper and lower stages, as shown in FIG. 5. Thus, gap 84 is equal to the distance the piston 20 deploys as it moves from the stowed position to the extended position.

After the piston 16 is fully extended, stage separation enters the isolation phase, as illustrated in FIG. 6. In the isolation phase, complete physical separation of the lower stage motor from the upper stage is achieved. Thus, a spacial gap 86 between the lower stage rocket motor 12 and the upper stage 14 is generated such that the two stages are no longer in physical contact. The creation of spacial gap 86 may be assisted or wholly accomplished by reducing, terminating, or reversing the forward thrust of the lower stage rocket motor 12 while allowing the remainder of the multi-stage missile to travel forward. Those of skill in the art will appreciate, however, that spatial gap 86 will be created more rapidly if the thrust of the lower stage rocket motor 12 is reversed so that the net thrust on the lower stage rocket motor 12 is in a direction opposite to the net thrust of the upper stage 14.

Following the detachment phase, pressure within the lower stage rocket motor's combustion chamber 18 bears against the piston 16, forcing it to move from the stowed position toward the extended position. In so moving, the piston 16 bears against the pusher pan 80, which in turn pushes the upper stage 14 away from the lower stage rocket motor 12 as shown in FIG. 5. The piston 16 is aligned within the piston guide 28 such that separation of the stages 12 and 14 is created without altering the course of the upper stage 14.

Because of the extreme pressures present within the combustion chamber 18 of the lower stage rocket motor 12 at the time of detachment, the piston 16 accelerates rapidly toward the extended position. Measures are therefore taken to prevent the piston 16 from being completely ejected from the lower stage rocket motor case 22.

As the piston 16 deploys from the stowed position to the extended position, the gradually increasing outside diameter of the piston's tapered section 38 (seen best in FIG. 4) causes mechanical interference between the piston 16 and the piston guide 28, thereby inducing substantial drag. Thus, a portion of the kinetic energy of the piston 16 is absorbed as the tapered section 38 of the piston 16 deploys through the piston guide collar 32.

In addition, deployment of the piston 16 from the stowed position to the extended position decreases the size of the mastic cavity 42, thereby compressing the mastic 46 within the reduced cavity 42. The piston flange 36, which helps define the mastic cavity 42, presses against the compressed mastic 46. The force exerted by the piston flange 36 against the mastic 46 extrudes the mastic 46 through the extrusion openings 44 in the flange 36. The size and placement of the extrusion openings 44 may thus be determined by one of skill in the art in accordance with the properties of the mastic material 46 so that a significant portion of the piston's kinetic energy is absorbed by this extrusion process.

The increased drag between the piston 16 and piston guide collar 32 acting in combination with the mastic extrusion process slow the piston's movement as it approaches the extended position. If the piston 16 reaches the fully extended position, the piston guide collar 32 will engage the piston flange 36, thereby acting as a stop to retain the piston 16 within the piston guide.

As the piston 16 deploys toward the extended position, the piston's venting passages 48 are unsealed, thereby venting the combustion chamber 18, as shown in FIG. 5. As the venting passages 48 become unsealed, plumes pass through the venting passages 48 which are aligned with the cut-outs 81 in the pusher pan 80 (FIG. 3), thereby avoiding direct contact with the upper stage. The venting passages 48 are preferably placed to direct their plumes 52 between any fins or other protrusions from the upper stage 14. The venting passages 48 also preferably have an angular orientation which directs the plumes 52 away from the upper stage 14. However, the angle 54 between the passages 48 and the missile's axis 56 also preferably ensures that a component of the resulting port thrust is in the aft direction.

In this preferred embodiment, the passages 48 are sufficiently large that the forward thrust of the lower stage rocket motor 12 is smaller than this aftward port thrust component, so the net thrust on the lower stage rocket motor 12 is in the reverse direction, as indicated by Arrow A. The rapid reversal of thrust on the detached lower stage rocket motor 12 causes it to quickly decelerate and become isolated from the upper stage 14.

During the isolation phase the upper stage 14 is also protected from contact with lower stage rocket motor combustion products. As shown in FIG. 5, protection is initially provided by the angular orientation of the venting passages 48, which directs the vented plumes 52 away from the upper stage 14. As shown in FIG. 6, protection against lower stage rocket motor emissions is later provided by the spatial gap 86 created between the upper and lower stages, since the plumes 52 have limited length.

Once the lowest stage rocket motor 12 is separated from the upper stage 14, the next stage motor may be ignited to further propel the missile towards its destination. The detached lower stage rocket motor 12 is free to fall to the earth as one integral piece, with the piston 16, the pusher pan 80, and the captured attachment bolt fragments still attached to the lower stage rocket motor. The apparatus 10 therefore achieves rapid and effective stage separation while producing no foreign object debris to endanger nearby aircraft.

From the foregoing it will be appreciated that the present invention provides a missile stage separation and thrust reduction apparatus which does not produce foreign object debris. Any attachment bolt fragments which are generated are captured and retained in the bolt fragment cavity of the lower stage rocket motor. No other potential foreign object debris is released by the invention during stage separation. In particular, no washers, retainers, or blowout plugs are expelled to endanger nearby aircraft.

It will be further appreciated that the present invention provides an apparatus that facilitates rapid separation of the lower stage rocket motor from the upper stage, to thereby prevent the stages from colliding or otherwise adversely interacting. The piston initially utilizes pressure from the lower stage rocket motor to press the pusher pan against the upper stage, thereby creating a gap between the upper stage and the lower stage rocket motor case. As the venting passages are exposed, the apparatus produces an aftward acting thrust vector by directing the combustion products of the lower stage motor in the forward direction. The aftward acting thrust component is preferably sized to exceed the forward acting thrust component produced by exhaust gas flowing through the motor nozzle. The resulting net thrust on the rocket motor acts to decelerate the lower stage rocket motor, thereby increasing the gap and isolating the upper stage from the lower stage rocket motor.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by patent is:

1. An apparatus for use with a multi-stage missile, the missile having an upper stage detachably connected to a forward end of a lower stage rocket motor, the lower stage rocket motor including a combustion chamber, the apparatus comprising:

a piston located at the forward end of the lower stage rocket motor, the piston being in fluid communication with the combustion chamber of the lower stage rocket motor and being configured with a venting passage, the piston being further configured for deployment from a stowed position, in which the piston is held in place by the connected upper stage and in which the venting passage is sealed, to an extended position, in which the venting passage is unsealed for venting the combustion chamber; and means for detaching the upper stage from the lower stage rocket motor to thereby permit deployment of the piston from the stowed position toward the extended position.

2. The apparatus of claim 1, wherein the piston is configured with a plurality of said venting passage configured to vent the combustion chamber generally toward the upper stage, thereby providing the lower stage rocket motor with a component of thrust away from the upper stage upon detachment of the lower stage rocket motor from the upper stage.

3. The apparatus of claim 1, wherein the lower stage rocket motor has a case configured with a piston orifice, and wherein the apparatus further comprises a piston guide attached within the piston orifice of the lower stage rocket motor case, the piston guide being aligned to guide the piston from the stowed position toward the extended position.

4. The apparatus of claim 1, further comprising a pusher pan attached to the forward end of the piston, the pusher pan abutting the upper stage when the piston is in the stowed position such that the pusher pan may transfer force from the piston to the upper stage as the piston deploys from the stowed position toward the extended position.

5. The apparatus of claim 1, wherein the means for detaching the upper stage from the lower stage rocket motor comprises:

at least one attachment bolt connecting the upper stage and the lower stage rocket motor; and an explosive detachment charge near each attachment bolt, each explosive detachment charge configured such that detonation of the charge causes the attachment bolt to fail, thereby releasing the upper stage from the lower stage rocket motor.

6. The apparatus of claim 3, wherein each explosive detachment charge is positioned within its corresponding attachment bolt.

7. The apparatus of claim 6, further comprising means for retaining any fragments of the attachment bolt which are generated upon detonation of the explosive detachment charge.

8. An apparatus for use with a multi-stage missile, the missile having an upper stage detachably connected to a forward end of a lower stage rocket motor, the lower stage rocket motor including a combustion chamber and configured with a piston orifice at its forward end, the apparatus comprising:

a piston positioned in the forward end of the lower stage rocket motor, the piston being in fluid communication with the combustion chamber of the lower stage rocket motor and being configured with a plurality of venting passages, the piston being further configured for deployment from a stowed position, in which the piston is held in place by the connected upper stage and in which the venting passages are sealed, to an extended position, in which the venting passages are unsealed for venting the combustion chamber;

a piston guide attached within the piston orifice of the lower stage rocket motor, the piston guide being aligned to guide the piston from the stowed position toward the extended position; and means for detaching the upper stage from the lower stage rocket motor to thereby permit deployment of the piston from the stowed position toward the extended position.

9. The apparatus of claim 8, wherein the piston has an aft end and the outside perimeter of the piston gradually increases toward the aft end of the piston such that as the piston deploys from the stowed position toward the extended position, mechanical interference between the piston and the piston guide induces drag as the portion of the piston having an increased perimeter contacts the piston guide.

10. The apparatus of claim 8, further comprising a pusher pan attached to the forward end of the piston, the pusher pan configured in abutment to the upper stage when the piston is in the stowed position, the pusher pan configured to transfer force from the piston to the upper stage as the piston deploys from the stowed position toward the extended position, thereby furthering isolation of the upper stage from the lower stage rocket motor.

11. The apparatus of claim 8, wherein the piston is substantially cylindrical, having a side and two ends.

12. The apparatus of claim 11, wherein the piston further comprises a substantially cylindrical metal shell disposed about a heat-resistant material.

13. The apparatus of claim 8, wherein the means for detaching the upper stage from the lower stage rocket motor comprises:

a plurality of attachment bolts connecting the upper stage and the lower stage rocket motor; and an explosive detachment charge within each attachment bolt, the detachment charge configured such that detonation of the charges causes the attachment bolts to fail, thereby releasing the upper stage from the lower stage rocket motor.

14. The apparatus of claim 13, wherein the explosive detachment charge causes the attachment bolt to break into fragments and wherein the apparatus further comprises an energy absorbing material positioned to receive and retain any fragments of the attachment bolt not retained in the upper stage.

15. The apparatus of claim 14, wherein the energy absorbing material is positioned in the lower stage rocket motor.

16. The apparatus of claim 8, wherein the piston has an aft end including a flange extending outwardly from the piston, and wherein the piston guide is further configured with a collar extending inwardly to engage the flange of the piston, thereby acting as a stop to retain the piston within the piston guide as the piston deploys from the stowed position toward the extended position.

17. The apparatus of claim 16, further comprising a mastic material positioned in at least a portion of a mastic cavity, the mastic cavity being bounded substantially by the collar, the flange, the piston, and the piston guide when the piston is in the stowed position, the mastic material selected to provide resistance between the piston and the piston guide as the piston deploys from the stowed position toward the extended position.

18. The apparatus of claim 17, wherein the flange of the piston includes an extrusion opening for placing the mastic cavity in fluid communication with the combustion chamber such that mastic material under pressure may extrude from the mastic cavity through the extrusion opening.

19. The apparatus of claim 17, wherein the mastic material has thermal insulation properties capable of shielding the piston from heat produced by the lower stage rocket motor, and wherein the mastic material substantially fills the mastic cavity.

20. An apparatus for use with a multi-stage missile, the missile having an upper stage detachably connected to a forward end of a lower stage rocket motor, the lower stage rocket motor being disposed about a combustion chamber and being configured with a piston orifice at its forward end, the apparatus comprising:

a piston positioned in the forward end of the lower stage rocket motor, the piston including a substantially cylindrical metal shell configured with a plurality of venting passages, the metal shell disposed about heat-resistant material, the piston being in fluid communication with the combustion chamber, the piston being further configured for deployment from a stowed position, in which the piston is held in place by the connected upper stage and in which the venting passages are sealed, to an extended position, in which the venting passages are unsealed for venting the combustion chamber;

a piston guide attached within the piston orifice of the lower stage rocket motor, the piston guide being aligned to guide the piston from the stowed position toward the extended position;

an attachment bolt connecting the upper stage and the lower stage rocket motor;

an explosive detachment charge near the attachment bolt, the charge configured such that detonation of the charge causes the attachment bolt to break into fragments, thereby releasing the upper stage from the lower stage rocket motor to permit deployment of the piston from the stowed position toward the extended position; and an energy absorbing material positioned in the lower stage rocket motor to receive and retain any fragments of the attachment bolt not retained in the upper stage.

* * * * *